United States Patent [19]

Newburger

[11] 4,357,721

[45] Nov. 9, 1982

[54] BATHING ASSEMBLY

[76] Inventor: Babette B. Newburger, 180 E. 79th St., New York, N.Y. 10021

[21] Appl. No.: 6,102

[22] Filed: Jan. 24, 1979

Related U.S. Application Data

[63] Continuation of Ser. No. 887,762, Mar. 17, 1978, abandoned.

[51] Int. Cl.[3] ..... A47K 3/06

[52] U.S. Cl. ..... 4/585; 4/584; 4/548; 4/538; 4/549

[58] Field of Search ..... 4/585, 584, 538, 548, 4/539, 550, 587

[56] References Cited

U.S. PATENT DOCUMENTS

| | | | |
|---|---|---|---|
| 223,907 | 1/1880 | Hammerstein | 4/540 |
| 237,494 | 2/1881 | Damen | 4/550 |
| 240,313 | 4/1881 | Fickett | 4/550 |
| 281,255 | 7/1883 | Fickett et al. | 4/548 |
| 356,545 | 1/1887 | Pauly | 4/550 |
| 469,570 | 2/1892 | Hurdel | 4/539 |
| 565,836 | 8/1896 | Butterfield | 4/539 |
| 1,767,800 | 6/1930 | Kennedy et al. | 4/548 |
| 2,518,604 | 8/1950 | Douglas | 4/548 |
| 3,187,350 | 6/1965 | Steven | 4/585 |
| 3,614,791 | 10/1971 | Newburger | 4/540 |
| 3,800,336 | 4/1974 | Hoxeng | 4/587 |
| 3,803,642 | 4/1974 | Erling et al. | 4/587 |

*Primary Examiner*—Henry K. Artis
*Attorney, Agent, or Firm*—Robert Scobey

[57] ABSTRACT

A collapsible bathing assembly utilizes a flexible liner housed within a cabinet. Rigid side walls for supporting the side walls of the liner are pivotally joined to the cabinet, and by pivoting action move the liner into and out of the cabinet. The rigid side walls and a rigid bottom support plate serve as the side walls and front wall of the cabinet when the liner is positioned within the cabinet and the bathing assembly is not in use. A rigid end wall is mounted for pivotal movement about an axis adjacent to the bottom of the liner to provide for the adjustable supporting of one of the ends of the liner, particularly to provide for collapsing of that liner end onto the bottom of the liner, resulting in easy access to the bathtub for an invalid. A framework is provided to support the top of the cabinet and to facilitate installation of the bathing assembly, including plumbing. The liner may be omitted, if desired, in which case the walls are provided with water-tight seals.

21 Claims, 18 Drawing Figures

Fig. 1.
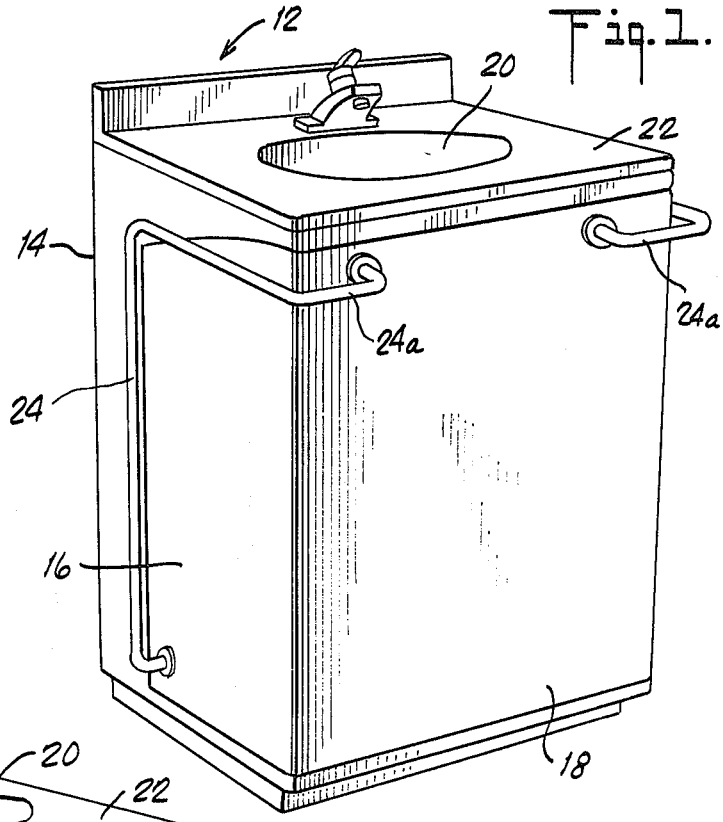
Fig. 3.
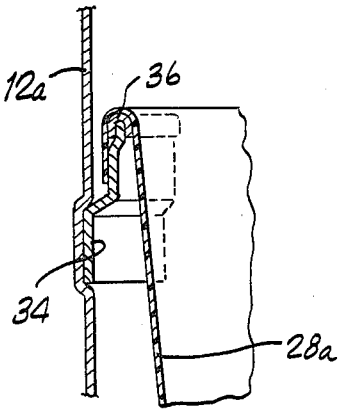
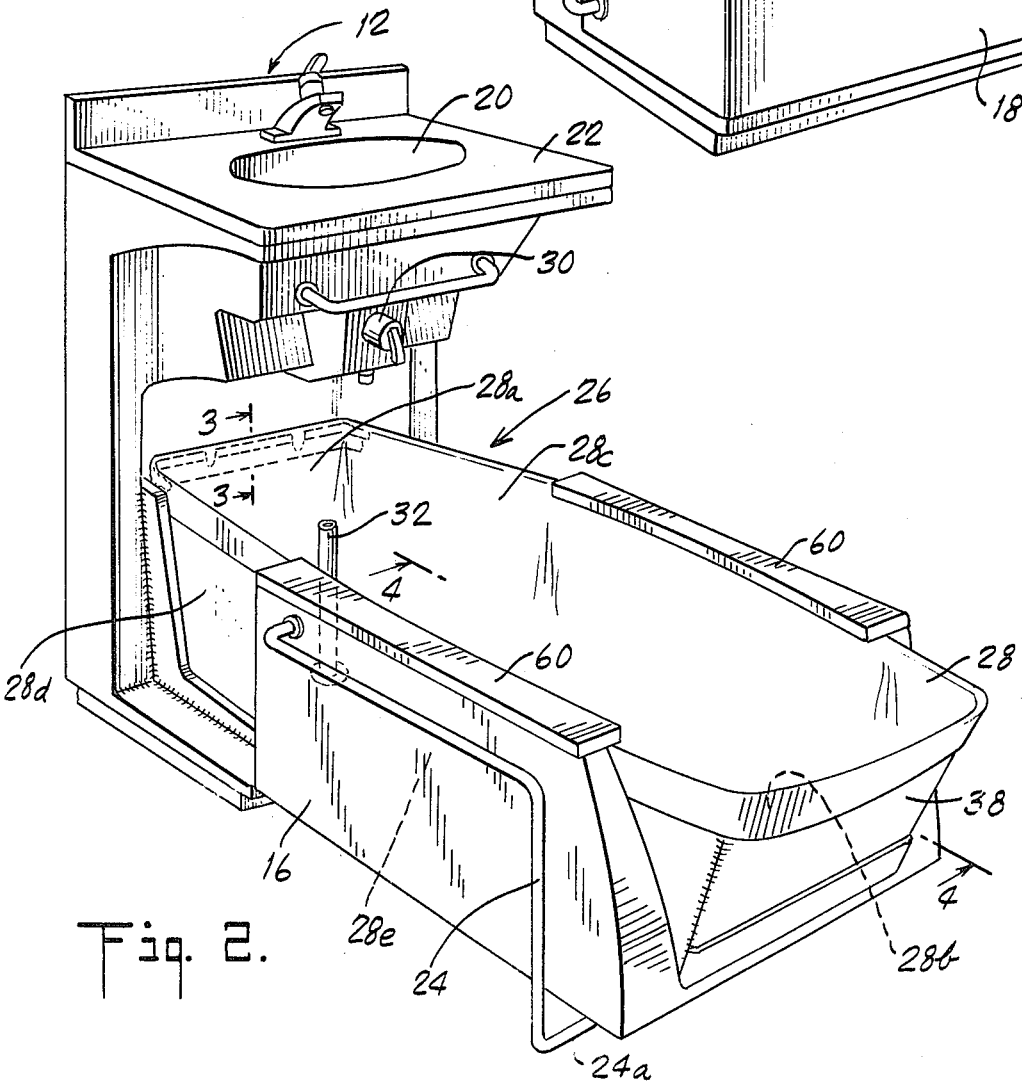
Fig. 2.

Fig. 6.
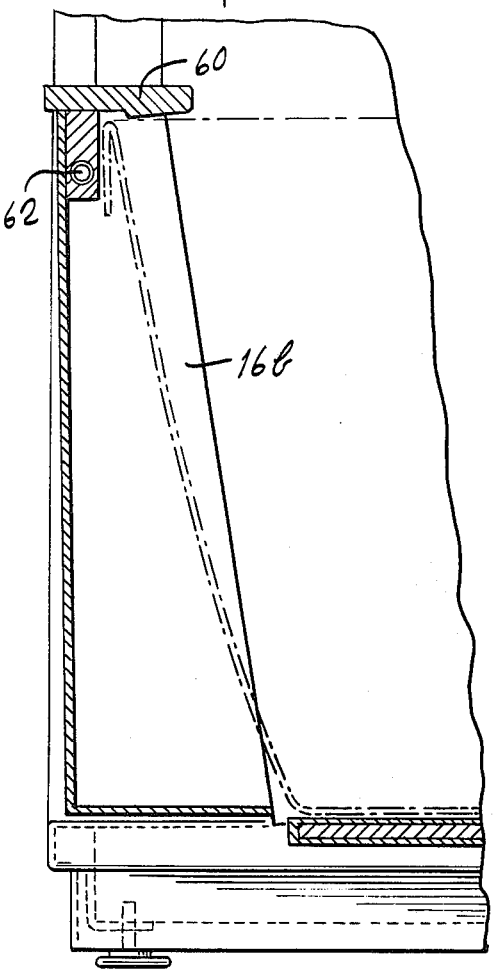
Fig. 9.
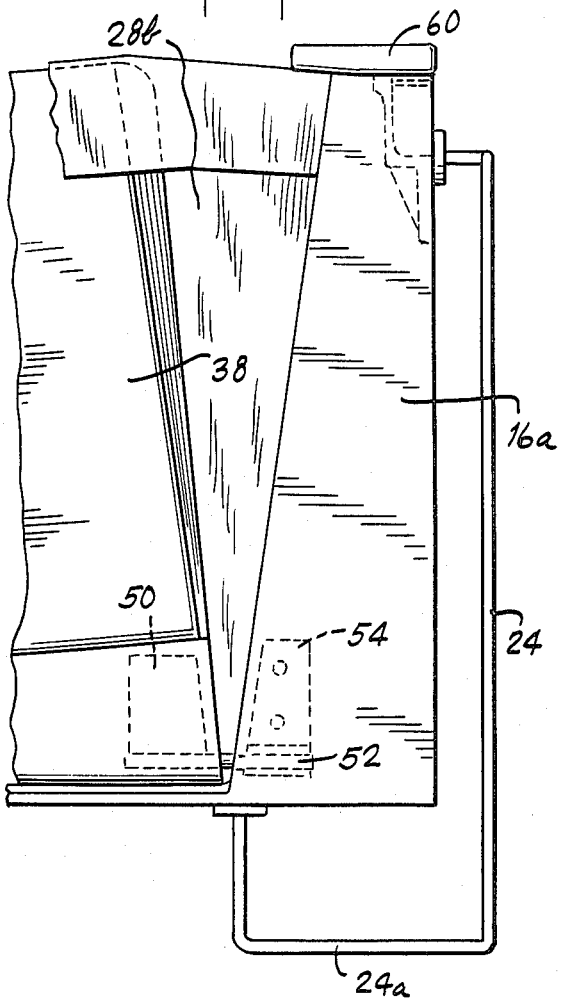
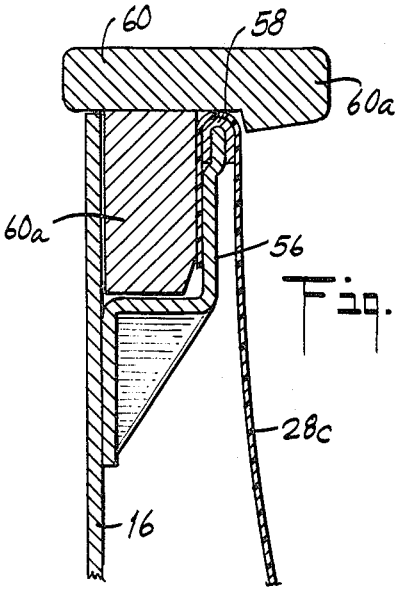
Fig. 7.
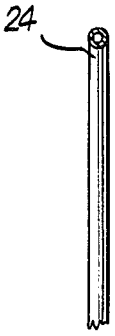
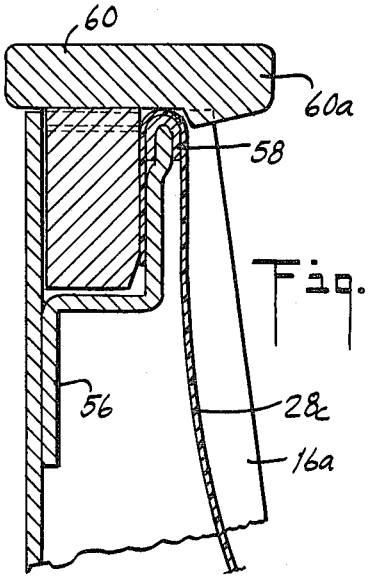
Fig. 8.

Fig. 11.
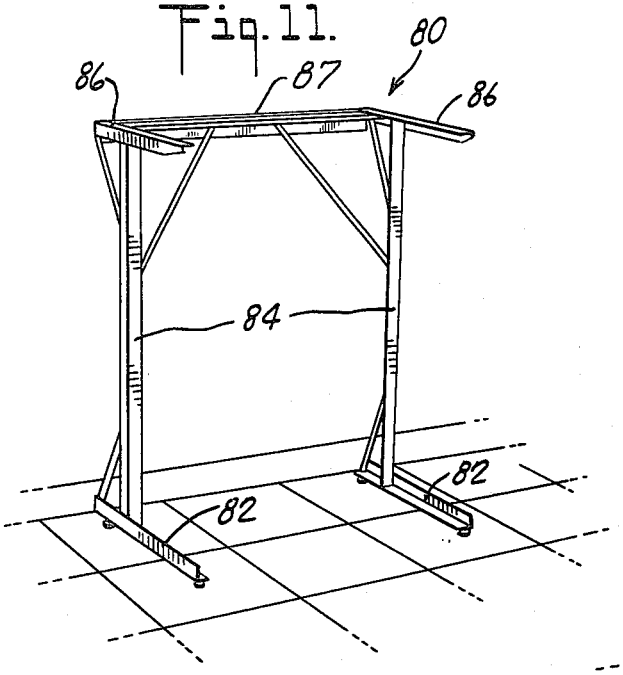
Fig. 12.
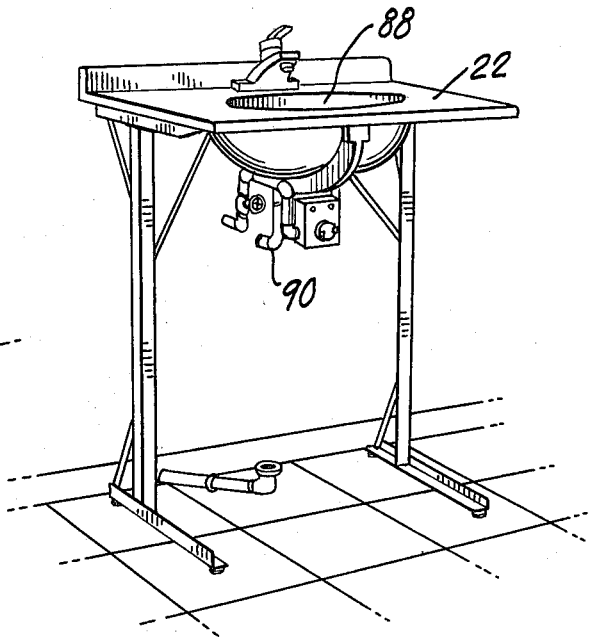
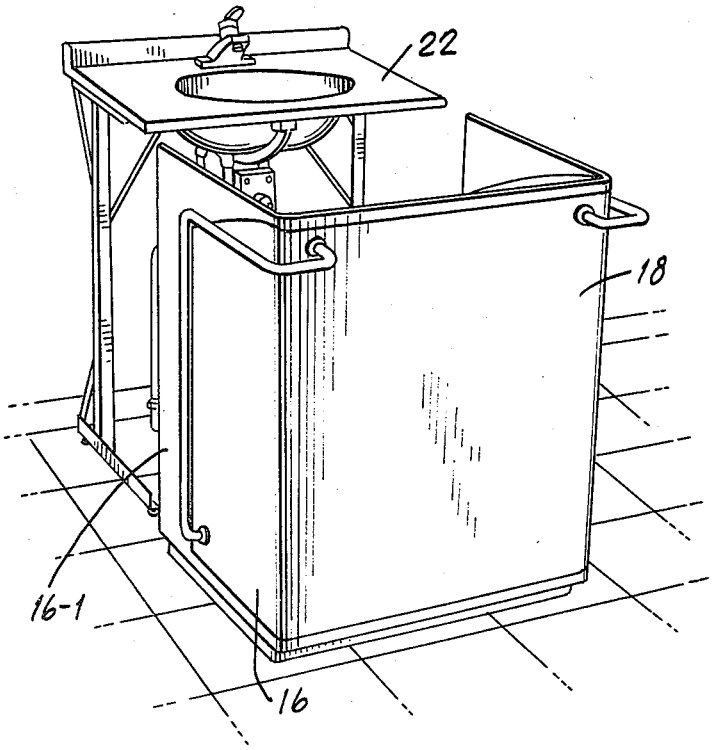
Fig. 13.

BATHING ASSEMBLY

This application is a continuation in part of Application Ser. No. 887,762, 3-17-78, and now abandoned.

BACKGROUND AND BRIEF DESCRIPTION OF THE INVENTION

This invention relates to bathing assemblies. More particularly, the invention provides a cabinet-mounted bathing assembly which finds widespread application.

In the present invention, a cabinet-mounted bathing assembly is provided which is portable or readily mounted for permanent installation, which is compact, which is readily and easily handled to move the bathtub component stored within the cabinet into use and storage positions, and which preferably uses a flexible liner for the bathtub that may be easily replaced so that a new liner may be substituted, as desired. The invention also provides for the collapsing of an end of the bathtub to permit easy access thereto by an invalid.

Cabinet mounted bathing assemblies are known. The following references are representative:

(1) U.S. Pat. No. 223,907, Jan. 27, 1880, Hammerstein
(2) U.S. Pat. No. 237,494, Feb. 8, 1881, Damen
(3) U.S. Pat. No. 281,255, July 17, 1883, Fickett et al
(4) U.S. Pat. No. 356,545, Jan. 25, 1887, Pauly
(5) U.S. Pat. No. 1,767,800, June 24, 1930, Kennedy et al
(6) U.S. Pat. No. 3,614,791, Oct. 26, 1971, Newburger
(7) Austrian Pat. No. 168,894 dated Sept. 10, 1951
(8) Article entitled "Doesn't Anyone Out There Need a Soft Bathtub", *The New York Times,* Sept. 2, 1976, Page 26.

None of the bathing assemblies disclosed in these references utilizes a collapsible end in accordance with the present invention; nor is there disclosed or suggested the use of side wall structures which form outside walls of the cabinet in accordance with the invention.

Collapsible bathing assemblies are also known, as disclosed in the following references:

(1) U.S. Pat. No. 545,243, Aug. 27, 1895, Miller
(2) U.S. Pat. No. 2,728,920, Jan. 3, 1956, Hylton et al
(3) U.S. Pat. No. 2,950,484, Aug. 30, 1960, Jaffe
(4) U.S. Pat. No. 4,034,424, July 12, 1977, Budlong
(5) British Pat. No. 21,920, Apr. 14, 1909, Bloom None of these references involves a cabinet mounted bathing assembly as is involved in the present invention.

C. J. Queen, U.S. Pat. No. 3,562,821, issued Feb. 16, 1971, discloses a bathing cabinet having a pivotable front door. Pivotable side walls of a multi-section bathtub assembly, as in the present invention, are not suggested.

In the present invention, as will be described in more detail below, a multi-section bathtub is provided, utilizing a pivotable section. Side and bottom walls of the bathing assembly preferably constitute side and front walls of the cabinet that houses the assembly. By providing dual functions to many of the parts of the assembly, the total number of components is reduced. When a liner for the bathtub is employed, it is simply attached so that it may be readily changed. This is important in hospital applications when, for reasons of disease prevention, it is desired to avoid use of a bathtub by other than a single patient. The liner assembly preferably utilizes a collapsible end wall, susceptible to adjustment, so that an invalid may gain easy access to the bathtub.

The cabinet parts are attached to a framework, which greatly facilitates installation.

The invention will be more completely understood by reference to the following detailed description.

BRIEF DESCRIPTION OF THE DRAWING

FIG. 1 is a perspective view of a bathing assembly (in bathtub storage condition) in accordance with the invention.

FIG. 2 is a perspective view of the bathing assembly of FIG. 1, in bathtub-use condition.

FIGS. 3 and 4 are sectional views, to enlarged scales, taken along the sections 3—3 and 4—4 in FIG. 2.

FIGS. 5 to 8 are sectional views, to enlarged scales, taken along the corresponding sections in FIG. 4.

FIGS. 9 and 10 are respectively perspective and partially sectional views of a bathtub drain useful in the bathing assembly of FIG. 1.

FIG. 11 is a perspective view of a framework used in the bathing assembly shown in the previous figures.

FIG. 12 is a perspective view of the framework of FIG. 11, supporting the top of the bathing assembly.

FIG. 13 is a perspective view of the framework and cabinet top of FIG. 12, with the remainder of the bathing assembly in position to be joined to the framework.

DETAILED DESCRIPTION

Figures 4, 9, 10:
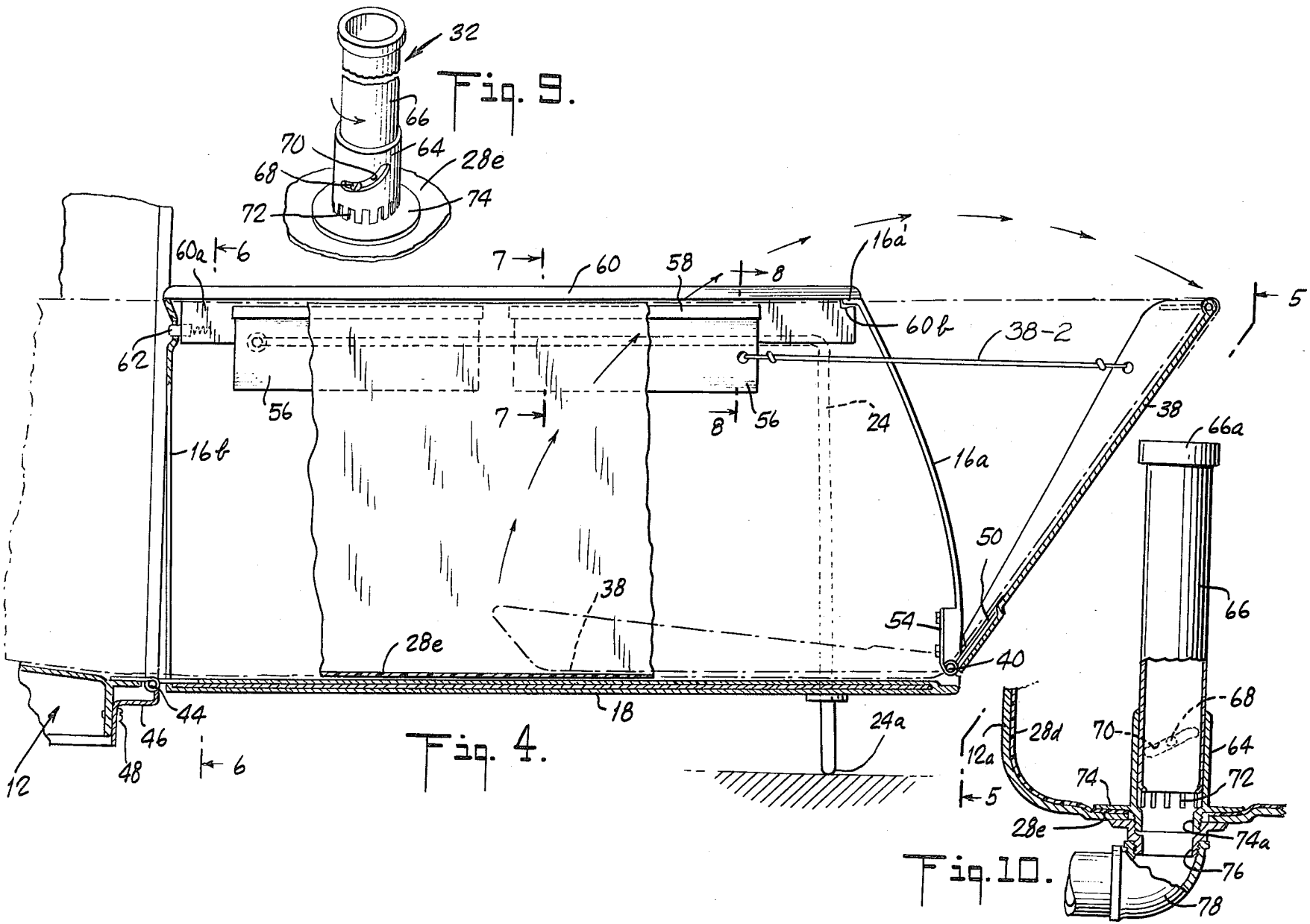

Referring to FIG. 1, a bathing assembly 12 is shown. The assembly comprises a cabinet 14 having side walls 16 (only one of which is shown in FIG. 1) and a front wall 18. A conventional sink 20 is mounted on top surface 22 of the cabinet. A towel rack 24 is included along the side walls 16 and front wall 18. As shown in FIG. 1, the bathing assembly 12 is in "closed" position, in which only the sink 20 is in active use.

FIG. 2 shows the bathing assembly 12 in "opened" condition in which bathtub portion 26 is also in active use. The bathing assembly is "opened" from the "closed" condition of FIG. 1 by grasping portion **24*a* of the towel rack 24 adjacent the front wall 18 of the bathing assembly. As will be explained in more detail below, the side and front walls 16 and 18 are caused to pivot to the position shown in which the bathtub 26 is ready for use. The bathtub 26 is preferably formed from flexible plastic material, for example, constituted by a liner 28. The liner 28 generally has end walls 28*a* and 28*b*, side walls 28*c* and 28*d*, and a bottom 28*e*. The bathtub is filled with water from a conventional water supply console 30, and a removable combined drain/overflow 32** conducts water from the bathtub.

Figure 18:
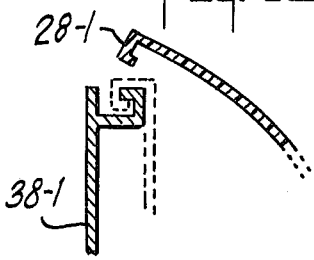
FIG. 18 is a partial sectional view showing an alternative, presently preferred liner support detail.

As noted above, the bathtub liner 28 is of flexible material, typically plastic, rubber or any other suitable material. The liner, along its top edge, is typically overturned, or formed with pockets, as shown in detail in FIG. 3. Alternatively, a beading 28-1 along the top edge of the liner may be employed, as shown in FIG. 18. FIG. 3 shows the releasable securing of the liner end wall **28*a* to the cabinet. In particular, rear wall 12*a* of the cabinet has a bracket 34 secured thereto. The bracket is capped along its upper edge by a trim strip 36, for example, of vinyl material, to avoid tearing or cutting of the liner 28. As is apparent from FIG. 3, the top edge of the liner is turned over or pockets the trim piece 36 to provide support for the liner end wall 28***a*.

The side walls 16 are of rigid material, for example, fiberglass, and provide support for the liner side walls 28*c* and 28*d*. The bottom 28*e* of the liner is supported by the rigid wall 18 forming a front wall of the cabinet, as shown in FIG. 1. In the in-use condition of the bathtub, the front wall 18 provides underlying support for the bottom 28*e* of the liner, as shown in FIG. 4. End wall 28*b* of the liner is supported by a rigid end wall 38, for example, of fiberglass material, as shown in FIGS. 2 and 4. Alternatively, the end wall 28*b* may be supported by a bracket such as 38-1 in FIG. 18, coacting with the beaded edge of the liner. With reference to FIG. 4, the rigid end wall 38 is pivotal about an axis adjacent to the liner bottom 28*e* by virtue of pivotal coupling 40 so that the rigid end wall, with liner, may pivot from the position shown in full lines (the bathing position) to a collapsed position shown in dashed lines in FIG. 4. In the collapsed position of the liner, the liner end wall 28*b* is collapsed onto and against the bottom 28*e* of the liner. Typically, prior to filling the bathtub with water, the liner end wall 28*b* is collapsed, permitting an invalid or other disabled person or any user to gain easy access into the bathtub. Next the end wall 38 is pivoted outwardly to the full line position shown in FIG. 4, and the tub is then filled. It will be noted that the liner restricts the outward pivoting of the end wall 38, as will be explained in more detail below.

Additionally or alternatively, a lanyard 38-2 may be employed for control and adjustment of the end wall 38. The lanyard is conveniently attached to bracket 56 and the end wall 38; two of such lanyards, one on each side of the tub, may be employed. The lanyards permit the collapsing of the end wall 38, as described above.

Pivotal Attachment of Cabinet Side Walls 16 to the Cabinet 12

The pivoting of the side walls 16 with respect to the cabinet 12 is shown in FIGS. 1 and 2. FIG. 4 shows the details of the pivotal attachment. Conventional piano-type hinge 44 is attached to the front wall structure 18. Alternatively, a hinge formed as part of the bathing assembly itself, e.g., part of the molded plastic defining the rigid tub structure, may be employed. Bracket 46, forming a part of the hinge is secured by screws 48 to cabinet 12. The hinge 44 provides the hinging of the wall 18 and that of the side walls 16 so that the latter may be pivoted between the position shown in FIGS. 1 and 2.

Pivotal Attachment of Rigid End Wall 38

The details of this pivotal mounting are shown in FIGS. 4 and 5. The pivotal coupling 40 is constituted of bracket 50 attached to the rigid end wall 38, which bracket includes pin 52 as part thereof. The pin 52 is received in a socket forming part of bracket 54 that is attached to end portion 16*a* of the side wall 16. Again, a simple hinging action is provided, permitting the rigid end wall 38 with liner 28 attached to pivot (about an axis adjacent to wall 18 that supports liner bottom 28*e*) between the positions (collapsed and erect) shown in FIG. 4.

Releasable Securing of Upper Edge of Liner 28

The releasable securing of the upper edge of the liner to the rear cabinet wall 12*a* was described above in connection with FIG. 3. FIGS. 4 to 8 show the details of mounting that upper liner edge to the side walls 6 and end wall 38. As shown in FIGS. 4 and 7, each side wall 16 includes brackets 56 attached thereto which are capped by a trim piece 58 (e.g., vinyl material) along the upper edge thereof to prevent cutting and tearing of the liner 28. As shown in FIG. 7, the upper edge of the liner is positioned or pocketed over the trim piece 58 and is held in place by a support member 60. That support member defines a tub rim or railing 60 at the top of the rigid sides 16, as shown in FIG. 2. The railing 60 binds the upper liner edge between it and the brackets 56, as shown in FIG. 7 (see also FIG. 8). As shown in FIGS. 7 and 8 inwardly directed portions 60*a* of the railing constitute a bathtub rim for directing splashed water back into the tub.

The railing 60 includes a downwardly depending portion 60*a*. This downwardly depending portion carries a spring loaded pin 62 (FIGS. 4 and 6) which engages an aperture in end portion 16*b* forming a part of the rigid wall structure 16. The other end of the railing 60 is cut away, as at 60*b* (FIG. 4), to engage lip extension 16*a*' of the upper part of side wall end portion 16*a* and to permit the swinging of the railing 60 into and out of position. In particular, the railing end containing the cut-away portion 60*b* is positioned in place, and the other end is swung downwardly, snapping the spring loaded pin 62 into the corresponding aperture when it is desired to secure the railing in place and to maintain the line 28 firmly in position against the side walls 16. When it is desired to change a liner, the railings 60 are removed by disengaging the spring loaded pin 62 with the corresponding aperture, and raising and removing the railing.

The liner end wall 28*b* is maintained in place over the rigid end wall 38 simply by extending over that rigid end wall, as shown in FIG. 5. To this end, the upper edge of the liner may include a plurality of discreet pockets, any one of which fits over the rigid end wall 38. In this fashion, the inclination of that end wall can be varied. Thus, by providing a liner 28 with sufficient slack in the region of the end wall 28*b* thereof, with different discreet pockets, each one of which may engage the rigid end wall 38, that end wall may be given more or less inclination to the vertical as desired by a user. What is required is that sufficient slack be provided so that, regardless of which pocket is actually used, the end wall 38 is capable of pivoting downwardly to the collapsed position shown in dashed line in FIG. 4 to enable a user to enter into the bathtub, as described above. The liner through engagement with end wall 38, restricts outward movement of the end wall. Thus, liner and rigid end wall each supports the other, and a simple mechanical coupling is provided without the need for a complicated adjustment mechanism as in the Jaffe patent cited above. For additional support of the end wall 38, lanyards 38-2, as described above, may be employed.

Bathtub Drain Overflow

Referring to FIGS. 9 and 10, the drain/overflow fixture 32 comprises an outer tube 64 and an inner tube 66 slidable within the outer tube. The sliding of the inner tube within the outer tube is guided by pin or dimple 68 carried by the inner tube 66 in slot 70 within the outer tube 64. The outer tube 64 is slotted in its lower portion, as at 72, and terminates in a lower flange 74 and threaded lower portion 74*a* (FIG. 10). The flange 74*a* threadedly engages a coupling 76. That coupling is positioned on the underside of the lower portion of cabinet rear wall structure 12*a* and may connect to a conventional drain line 78 or drain into a European style floordrain (not shown). Bottom liner portion 28*e* is sandwiched between that lower wall structure portion and flange 74 in a water-tight fit. When it is desired to change liners, the outer tube 64 is rotated so as to disengage the threaded couplings 74*a*/76, permitting the entire drain structure 32 to be removed, a new liner inserted, and the drain structure to be replaced. Alternatively, drain and liner may be formed as one unit and disposable.

The overflow function of the drain structure is provided by water passing through open upper end 66*a* of the inner tube 66. When it is desired to retain water within the tub, the inner tube 66 is moved to its lowermost position, closing off the slots 72. When it is desired to drain the tub, that inner tube is raised to its uppermost position, permitting water to drain from the tub through the slots 72 and into drain line 78. In this regard, drain line 78 is typically positioned on or above the floor supporting the entire cabinet structure 12. Thus when the bathing assembly is installed, a simple connection to a conventional floor drain is all that is required, without any destruction of the underlying floor, or no connection whatsoever is needed if a European style floor drain is provided below the coupling 76. It should also be noted that the portion 24*a* of the towel rack which constitutes a handle to be grasped by a user in activating the tub forms a means for supporting the rigid bottom support structure 18 above the floor and above the floor drain structure with which the tub communicates. The rigid bottom structure may be inclined to provide for easy drainage of water.

In place of conventional draining of the tub, water may be pumped therefrom, if desired. The filling of the tub may be by any suitable means.

FIGS. 11 to 13 show the use of a framework 80 used for installing the bathing assembly 12. The framework 80 includes leg portions 82, side portions 84 top portions 86, and back plate 87 used to attache the framework to a wall. The top structure 22 of the bathing assembly, containing washbasin 88 therein is attached to the top portions 86 of the framework, as shown in FIG. 12. If desired, at this time plumbing, designated by numeral 90 may be secured. Finally, as shown in FIG. 13, the remainder of the bathing assembly previously described, which includes the pivotable wall structures 16 and 18 may be attached to the framework. It will be noted that a second side wall 16-1 is included which, together with the side wall 16, defines a complete side of the cabinet structure. The side wall 16-1 is affixed to the framework 80, by attachment, e.g., to the framework pieces 86.

It is apparent that the bathing assembly, as a single complete unit consisting of framework 80, top structure 22, wall structures 16-1, 16 and 18, including liner and all other items previously described may be completed as one unit, preassembled beforehand and moved to a site for installation. On the other hand, the different parts of the assembly, as separately shown in FIGS. 11 and 13, may be provided separately, for assembly at a site, as desired. Furthermore, the framework permits disattachment of the top structure 22 and/or the remainder of the cabinetry for servicing of the plumbing, as needed.

FIGS. 14–17

Figure 14:
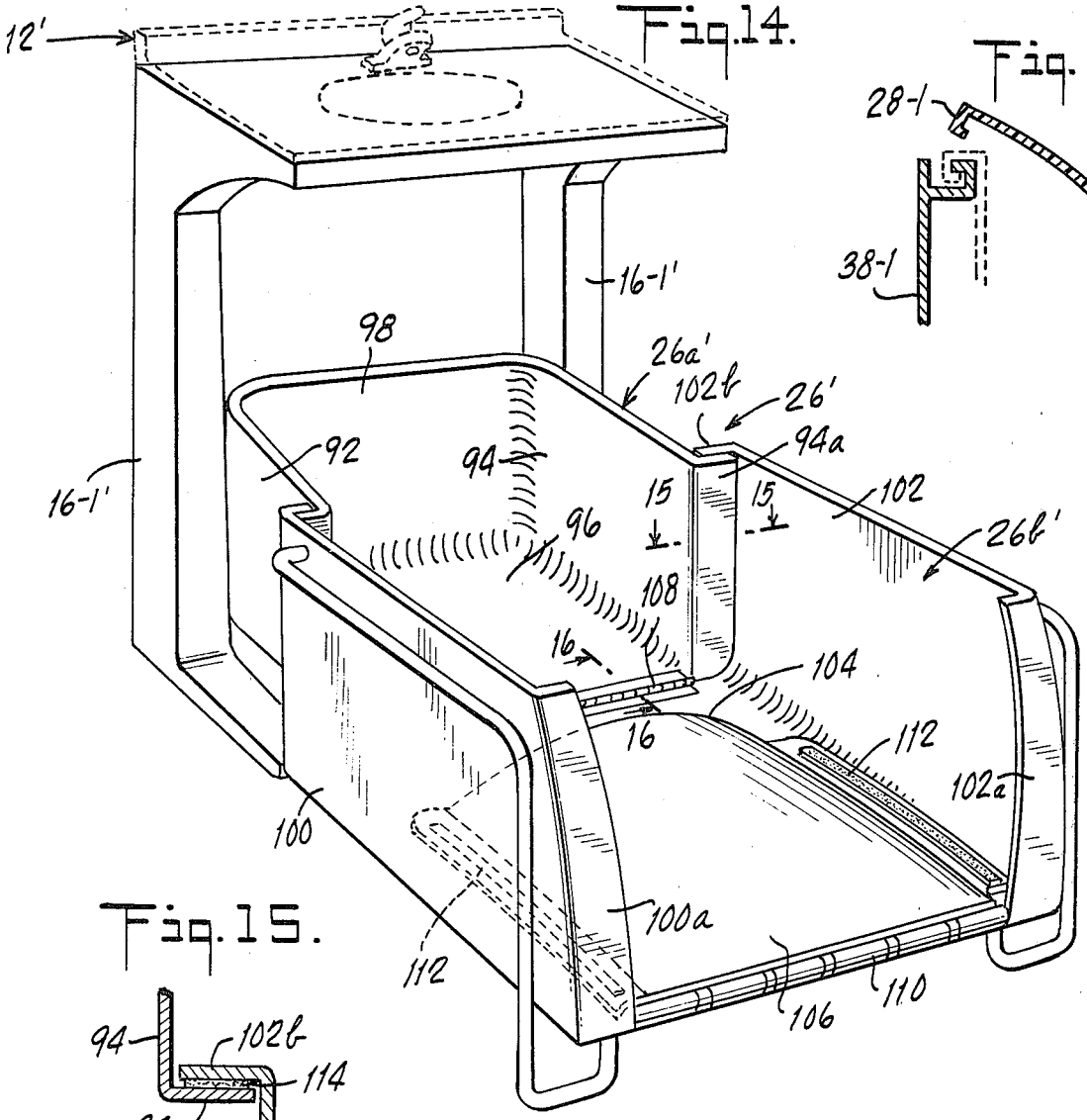
FIG. 14 is a perspective view of an alternative bathing assembly embodying the invention.

These figures show an alternative bathing assembly not utilizing a flexible liner for a bathtub. The assembly includes a cabinet 12' having fixed partial side wall structures 16-1'. A bathtub 26' is included, formed from two sections 26*a'* and 26*b'*. Each of these sections has side and bottom and end walls, i.e., the bathtub section 26*a'* has side walls 92 and 94, a bottom wall 96, and an end wall 98, while the other tub section 26*b'* has side walls 100 and 102, a bottom wall 104, and an end wall 106. The bottom walls 96 and 104 of the two bathtub sections are hingedly joined to each other by use of hinge 108. Thus, the two bathtub sections 26*a'* and 26*b'* may pivot with respect to each other. As shown in FIG. 14, the bathtub section 26*a'* is fixed in place inside the cabinet 12', while the section 26*b'* is pivotal into and out of the cabinet. FIG. 14 shows the "in use" position of the bathtub 26'. In the "non-use" position of the tub, the tub section 26*b'* is pivoted about the hinge 108 into closed position in which the tub sides 100 and 102 interfit with the fixed cabinet sides 16-1'. The interfitting of these sides is the same as shown in the other embodiment of FIG. 1. It will be noted that the bottom wall 104 of the tub section 26*b'* constitutes the front face of the cabinet 12' when the bathtub 26' is in the closed or "non-use" position, as in the case of the embodiment of FIG. 1.

Figure 17:
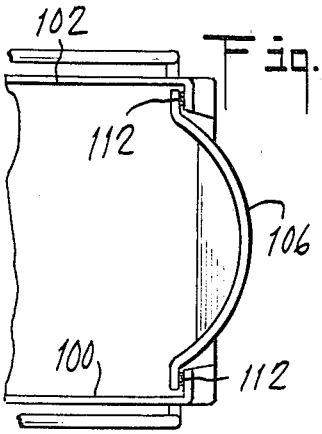
FIG. 17 is a top view, to a reduced scale, of part of the bathing assembly of FIG. 14.

The end wall 106 of the tub section 26*b'* is pivotal about a hinge 110. Thus, this end wall may be pivoted to a position as shown in FIG. 14 in which it is adjacent the bottom wall 104, permitting easy access of a person into the bathtub. The end wall is thereafter raised, and assumes the position as shown in FIG. 17. The end wall 106 may be curved as is apparent from FIGS. 14 and 17, so as to be more comfortable to a user seated in the bathtub with his back against the end wall 106.

Figure 15:
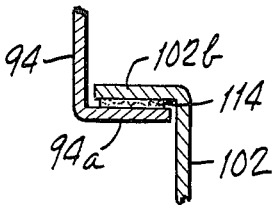
FIGS. 15 and 16 are sectional views, to enlarged scales, taken along the sections 15—15 and 16—16 in FIG. 14.
Figure 16:
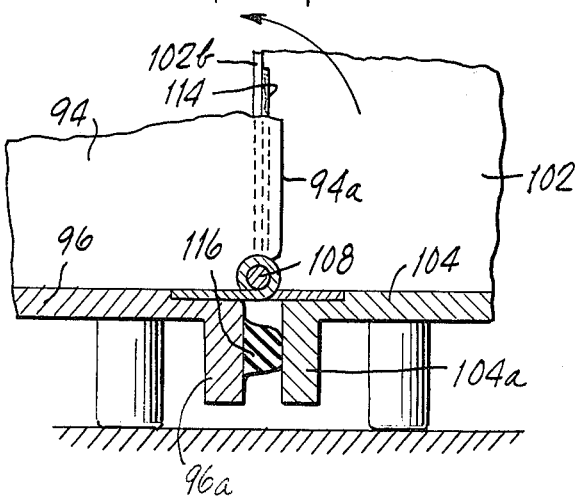

For sealing purposes, gaskets 112 may be included on the end wall 106 which bear against flanged portions 100*a* and 102*a* of the side walls 100 and 102 of the bathtub section 26*b'*. The tub sections 26*a'* and 26*b'* may be rendered water tight by the use of gaskets between adjacent sections thereof. For example, as shown in FIGS. 14 and 15, the two tub section side walls 94 and 102 terminate in flanges 94*a* and 102*b*, one of which may carry a gasket 114 that is pinched between the two flanges when the two tub sections are in the "in use" position shown in FIG. 14. The opposite tub side walls 92 and 100 may be similarly sealed with respect to each other. At the bottom of the tub, the two bottom walls 96 and 104 may terminate in flanges 96*a* and 104*a*, as shown in FIG. 16. A resilient gasket material 116 is carried by one of the flanges, for example, the flange 96*a*, and serves to seal this portion of the bathtub in a water tight seal. To this end, the resilient gasket material 116 may advantageously constitute a continuation of the gasket material 114 sealing the sides of the bathtub sections. Similar sealing of the end wall 106 in the region of the hinge 110 may be employed to render that end of the bathtub water tight.

It will thus be apparent that the assembly of FIGS. 14 to 17 is similar in many details to the assembly of FIGS. 1 to 13, except that no flexible liner is utilized in the assembly of FIGS. 14 to 17.

SUMMARY

It will be noted that a unique modular bathing assembly has been provided that is housed in a cabinet preferably containing a sink and a fold-away bathtub with drain and overflow features. In this regard, it should be noted that permanent attachment to plumbing may easily be provided, by virtue of the simple disattachment of cabinentry from framework, or a truly portable assembly may be implemented using a simple drain outlet from the liner which drains into a conventional floor drain, as found in a conventional shower. Water evacuation by means of a pump may be utilized, and a hand shower, forming a part of the water console 30 shown in FIG. 2, may be utilized. The assembly is thus positioned permanently in place or may be portable, and is adaptable to all standard plumbing codes.

Important advantages of the bathing assembly are economy of space and installation, safety, replaceability and disposability of the bathtub liner, when a liner is employed, as well as energy conservation. Economy of space and installation are desirable due to increased cost of housing, rapid deterioration of building structures in urban density areas, population expansion, and application in the rehibilitation of existing structures.

The above-the-floor drain system allows easy and economic installation in existing structures with existing or new plumbing.

The assembly provides a safe facility which permits the young and the aged, the infirm and the well to bath without risk of injury due to a fall in the bathtub.

The assembly provides hand-rail or arm rest aids, constituted of a railing or padded or formed rims which serve to hold the liner in place, and brackets described above, when a liner is utilized. Such arm rests may serve as a bathtub rim to redirect splashed water back into the tub. Side hand straps may be included as part of the side wall structures for safer entry into and exit from the bathtub. Because of the unique pivotal back assembly, the bather may walk into and out of the bathtub. Thus the bathing of a patient by others is facilitated from the sides of the bathtub.

The liner, when used, may be padded for safety and comfort between portions thereof and the associated rigid wall structures there-against. Liners of single or double skins may be provided, including eutectic salts for heating purposes, or aluminum balls between the skins, for heat, safety, comfort and therapy. The liner may itself be lined, for example, by aluminum, so as to be readily available for disposal of seriously contaminated materials by burial.

By the use of a removably (slip-on) attached flexible liner, the bathtub itself may be changed simply, as desired. This feature is particularly important for hospitals and nursing homes where the cleansing of a bathtub after each use by a different patient is costly and does not necessarily remove all germs. This system provides a completely sterile environment through the changing of a liner.

The nature of conventional liner materials renders the liner susceptible to sonic wave treatment, if desired, rendering such treatment possible at the tub-side. The liner and supporting wall structures and including tub walls (without liner) may be specially shaped, as desired, for body-conforming comfort or conservation of water.

Both liner and non-liner versions of bathing assemblies may be shifted easily between the bathtub use and bathtub non-use positions described above. In the bathtub non-use position, the assemblies are amazingly compact.

The presently preferred embodiments described above are susceptible to modification. Thus, for example, the washbasin may be dispensed with, and only a cabinet-housed bathtub provided, if desired. Pivoting of plural walls, rather than just an end wall, as shown may be provided. The pivoted part of the assembly may be spring-loaded, if desired, to assist the user in pivoting the unit into and out of in-use positions. Many of the specific assembly details may be obviously changed by those skilled in this art, all within the spirit and scope of the invention. That invention is accordingly defined by the following claims.

What is claimed is:

1. A collapsible bathing assembly comprising a flexible liner defining a bathtub and generally having end and side walls and a bottom, a cabinet for housing the liner therein, said cabinet including first support means for supporting a first end of said liner, rigid side walls pivotally joined to said cabinet for supporting said liner side walls and by pivoting action moving said liner into and out of said cabinet, and a rigid end wall pivotally attached to said side walls adjacent the bottom of the latter for collapsibly supporting a second end of said liner opposite said first end for collapsing of said second liner end onto the bottom of said liner.

2. A bathing assembly according to claim 1, in which said first support means forms a part of a back wall of said cabinet.

3. A bathing assembly according to claim 1, in which said rigid side walls form side walls of said cabinet when pivoted to a position in which said liner is positioned within said cabinet.

4. A bathing assembly according to claim 3, in which said rigid side walls are joined by a rigid plate forming a support for the bottom of said liner as well as a front wall of said cabinet when said rigid side walls are pivoted to said position in which said liner is positioned within said cabinet.

5. A bathing assembly according to claim 1, in which said liner is releasably secured to said first support means and to said rigid side walls and to said rigid end wall.

6. A bathing assembly according to claim 5, in which said liner is so releasably secured along only the top edge thereof.

7. A bathing assembly according to claim 6, in which each of said rigid side walls includes bracket means over which the top edge of said liner is positioned, and a support plate releasably secured to said bracket means and binding said upper liner edge between it and said bracket means.

8. A bathing assembly according to claim 7, in which said support plate defines a rim at the top of said rigid sides for seating support and for directing splashed water back into said bathtub.

9. A bathing assembly according to claim 1, including a drain from said liner, said drain being releasably secured to said liner.

10. A bathing assembly according to claim 1, in which said rigid side walls are joined by a rigid plate forming a support for the bottom of said liner, and including a railing along said rigid side walls and bottom support, the portion of said railing along said bottom support constituting a handle for grasping by a user as well as a means for supporting said bottom support in spaced relation above a floor.

11. A bathing assembly according to claim 1, in which said rigid side walls are joined by a rigid plate forming a support for the bottom of said liner, said rigid side walls forming side walls of said cabinet and said rigid plate forming a front wall of said cabinet when said rigid side walls are pivoted to a position in which said liner is positioned within said cabinet, said rigid side walls being pivoted about bottom portions thereof to said cabinet, said first support means forming a part of a back wall of said cabinet, and said rigid side walls being spaced from said back wall of said cabinet when pivoted to a bathing position in which said liner is positioned outside said cabinet.

12. A bathing assembly comprising a bathtub structure, a cabinet for housing said bathtub structure, a side wall constituting a side of said bathtub structure, said side wall being pivotally attached to said cabinet adjacent the bottom thereof for pivoting said bathtub structure into and out of said cabinet, said side wall forming a side of said cabinet when pivoted to a position in which said bathtub structure is positioned within said cabinet.

13. A bathing assembly according to claim 12, including a support plate constituting the bottom of said bathtub structure, said support plate being joined to said side wall and forming a front of said cabinet when said side wall is pivoted to said position in which said bathtub structure is positioned within said cabinet.

14. A bathing assembly according to claim 12, in which said assembly includes a second side wall which, together with said first side wall, defines a complete side of said cabinet.

15. A bathing assembly according to claim 14, including a framework for supporting said cabinet, said second side wall being affixed to said framework.

16. A bathing assembly according to claim 15, including a top of said cabinet, said top being affixed to said framework.

17. A bathing assembly according to claim 12, in which said bathtub structure is comprised of two sections pivotally jointed to each other about said pivotal attachment of said side wall to said cabinet.

18. A collapsible bathing assembly comprising a flexible liner defining a bathtub and generally having a side wall and a bottom, wall structure support means for supporting said liner side wall, said wall structure support means including a panel pivotally mounted about an axis adjacent to said liner bottom for collapsibly supporting said liner side wall for collapsing onto said liner bottom, said liner side wall including means for engaging said panel and restricting the outward pivoting of said panel.

19. A collapsible bathing assembly as in claim 18, including a flexible lanyard joined to said side wall for restricting the outward pivoting of said panel.

20. A bathing assembly comprising a bathtub structure, a cabinet for housing said bathtub structure, said bathtub structure being divided into two sections, each section having side and bottom and end walls, said bottom walls of said two bathtub sections being hingedly joined to each other so that one bathtub section pivots with respect to the other bathtub section, including sealing means for making a water-tight seal between said two bathtub sections.

21. A bathing assembly according to claim 20, in which one of said bathtub sections is fixed in place inside said cabinet, and the other of said sections is pivotal into and out of said cabinet.

* * * * *